US009181657B2

(12) United States Patent
Castro et al.

(10) Patent No.: US 9,181,657 B2
(45) Date of Patent: Nov. 10, 2015

(54) METHOD OF INCREASING PAPER STRENGTH BY USING NATURAL GUMS AND DRY STRENGTH AGENT IN THE WET END

(71) Applicant: Nalco Company, Naperville, IL (US)

(72) Inventors: David J. Castro, DeKalb, IL (US); Weiguo Cheng, Naperville, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 13/731,311

(22) Filed: Dec. 31, 2012

(65) Prior Publication Data

US 2014/0182800 A1 Jul. 3, 2014

(51) Int. Cl.

| | |
|---|---|
| ***D21H 17/31*** | (2006.01) |
| ***D21H 17/32*** | (2006.01) |
| ***D21H 17/45*** | (2006.01) |
| ***D21H 17/69*** | (2006.01) |
| ***D21H 21/10*** | (2006.01) |
| ***D21H 21/20*** | (2006.01) |
| ***D21H 21/18*** | (2006.01) |

(52) U.S. Cl.

CPC ..... *D21H 17/31* (2013.01); *D21H 21/18* (2013.01)

(58) Field of Classification Search

USPC ..... 162/158, 164.1, 164.6, 164.3, 162/168.1–168.3, 175, 178, 180, 181.1, 162/181.2, 181.5, 181.8, 285; 106/400, 106/401, 456, 459, 460, 461, 463–468, 500, 106/501.1

See application file for complete search history.

(56) References Cited

U.S. PATENT DOCUMENTS

| | | | | | |
|---|---|---|---|---|---|
| 2,322,185 | A * | 6/1943 | Bicknell | 162/178 |
| 2,949,397 | A * | 8/1960 | Gilman et al. | 162/178 |
| 3,184,373 | A * | 5/1965 | Arledter | 162/152 |
| 3,556,932 | A * | 1/1971 | Coscia et al. | 162/166 |
| 4,495,245 | A * | 1/1985 | Zunker | 428/403 |
| 4,925,530 | A * | 5/1990 | Sinclair et al. | 162/164.1 |
| 4,943,349 | A * | 7/1990 | Gomez | 162/158 |
| 5,017,268 | A * | 5/1991 | Clitherow et al. | 162/146 |
| 5,458,679 | A * | 10/1995 | Fairchild | 106/465 |
| 7,951,265 | B2 * | 5/2011 | Esser et al. | 162/166 |
| 2002/0088595 | A1 * | 7/2002 | Edwards et al. | 162/358.1 |
| 2005/0155731 | A1 | 7/2005 | Martin | |
| 2012/0103548 | A1 | 5/2012 | Zhao et al. | |

FOREIGN PATENT DOCUMENTS

| | | | |
|---|---|---|---|
| EP | 0361763 | A2 | 4/1990 |
| WO | 2011116253 | A2 | 9/2011 |

OTHER PUBLICATIONS

Smook, Gary A., Handbook for Pulp and Paper Technologists, 2nd ed, Angus Wilde Publications, 1992, p. 220.*

International Search Report mailed Apr. 15, 2014 for related PCT application PCT/US2013/075377. (10 Pages).

* cited by examiner

*Primary Examiner* — Dennis Cordray

(74) *Attorney, Agent, or Firm* — Leydig, Voit & Mayer, Ltd.

(57) ABSTRACT

The invention provides a method of improving dewatering efficiency, increasing sheet wet web strength, increasing sheet wet strength and enhancing filler retention in a paper-making process. The method improves the efficiency of drainage aids or wet web strength aids or wet strength aid by coating at least some of the filler particles with a natural gum and with a material that prevents the filler materials form adhering to those additives. The drainage additive or wet web strength additive or wet strength aid holds the cellulose fibers together tightly and is not wasted on the filler particles.

12 Claims, No Drawings

METHOD OF INCREASING PAPER STRENGTH BY USING NATURAL GUMS AND DRY STRENGTH AGENT IN THE WET END

CROSS-REFERENCE TO RELATED APPLICATIONS

This application is related to U.S. patent application Ser. No. 13/449,888, filed on Apr. 18, 2012, issued Jun. 10, 2014 as U.S. Pat. No. 8,747,617, which is a continuation-in-part of U.S. patent application Ser. No. 11/854,044, filed Sep. 12, 2007, issued May 8, 2012 as U.S. Pat. No. 8,172,983. This application is also related to U.S. patent application Ser. No. 12/975,596, filed Dec. 22, 2012, issued Feb. 26, 2013 as U.S. Pat. No. 8,382,950, which is a continuation-in-part of U.S. patent application Ser. No. 11/854,044, issued as U.S. Pat. No. 8,172,983, previously discussed. Each aforementioned disclosure is incorporated herein by reference in its entirety.

STATEMENT REGARDING FEDERALLY SPONSORED RESEARCH OR DEVELOPMENT

Not Applicable.

BACKGROUND OF THE INVENTION

This invention relates to a method of increasing sheet wet web strength, increasing sheet wet strength and enhancing filler retention in a papermaking process. Typically in a papermaking process chemicals are added in the wet end to assist in the dewatering of the slurry, increasing retention and improving wet or dry sheet strength. The wet end of the papermaking process refers to the stage in the papermaking process where the fiber is dispersed in the water in the slurry form. The fiber-water slurry then go through drainage and dewatering process to form a wet web. The solid content after this wet formation process is about 50%. The wet web is further dried and forms a dry sheet of paper mat. Paper mat comprises water and solids and is commonly 4 to 8% water. The solid portion of the paper mat includes fibers (typically cellulose based fibers) and can also include filler.

Fillers are mineral particles that are added to paper mat during the papermaking process to enhance the resulting paper's opacity and light reflecting properties. Some examples of fillers are described in U.S. Pat. Nos. 5,458,679, 5,104,487, 7,211,608, 8,088,250, and European Patent Specification 0 470 871 B1. Fillers include inorganic and organic particle or pigments used to increase the opacity or brightness, reduce the porosity, or reduce the cost of the paper or paperboard sheet. Some examples of fillers include one or more of: kaolin clay, talc, titanium dioxide, alumina trihydrate, barium sulfate, magnesium hydroxide, pigments such as calcium carbonate, and the like.

Calcium carbonate filler comes in two forms, GCC (ground calcium carbonate) and PCC (precipitated calcium carbonate). GCC is naturally occurring calcium carbonate rock and PCC is synthetically produced calcium carbonate. Because it has a greater specific surface area, PCC has greater light scattering abilities and provides better optical properties to the resulting paper. For the same reason however, PCC filled paper mat produces paper which is weaker than GCC filled paper in dry strength, wet strength and wet web strength.

Filler is generally much smaller than fiber, therefore, filler has much larger specific surface area than fiber. One of the challenges people found to increase filler content in the sheet is that high filler content decreases the efficiency of wet end chemicals, such as dewatering aids, wet web strength aids and wet strength aids. This invention is to provide novel filler pretreatment, so that it reduced the adsorption of wet end chemicals onto filler surface, therefore, increased the efficiency of wet end chemicals such as dewatering aids, wet web strength aids and wet strength aids.

Paper wet web strength is very critical for paper producers because increased paper wet web strength would increase machine runnability and reduce sheet breaks and machine down time. Paper wet web strength is a function of the number and the strength of the bonds formed between interweaved fibers of the paper mat. Filler particles with greater surface area are more likely to become engaged to those fibers and interfere with the number and strength of those bonds. Because of its greater surface area, PCC filler interferes with those bonds more than GCC.

Paper dewatering efficiency is also very critical for paper producers because decreased dewatering efficiency in wet web would increase steam demand for drying operation, reduce machine speed and production efficiency. Dewatering aids are widely used to improve dewatering efficiency for reducing energy consumption, increasing machine speed and production efficiency.

Thus there is a clear need for and utility in an improved method of and composition for increasing paper strength in the wet end of a papermaking process. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment of the invention is directed towards a method of papermaking comprising filler. The method comprises the steps of: providing filler particles and cellulose fiber stock, treating either the filler particles or the cellulose fiber stock with a composition comprising at least one natural gum, treating the cellulose fiber stock with a wet web strength additive, combining the filler particles and cellulose fiber stock, and forming a paper mat from the combination. The cellulose fiber stock comprises a plurality of cellulose fibers and water. The resulting paper has greater strength than the sum of the strength improvements that the natural gum composition and the wet web strength additive impart alone.

The natural gum composition may be added to the filler particles before they are added to the cellulose fiber stock. The natural gum composition may be added to the cellulose fiber stock. The wet web strength additive may comprise GPAM. The method may further comprise the step of adding a drainage aid to the cellulose fiber is stock. At least some of the filler particles may be calcium carbonate in one form selected from the list consisting of undispersed calcium carbonate, dispersed slurry calcium carbonate, chalk, PCC, GCC and any combination thereof. At least a portion of the calcium carbonate may be in a dispersed slurry calcium carbonate form, the dispersed slurry calcium carbonate further comprising at least one item selected from: polyacrylic acid polymer dispersants, sodium polyphosphate dispersants, Kaolin clay slurry, and any combination thereof. The wet web strength additive may be a coagulant selected from the list consisting of: inorganic coagulants, organic coagulants, condensation polymerization coagulants, and any combination thereof.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"AcAm" means a copolymer constructed out of polymerized acrylic acid monomeric units and polymerized acrylamide monomeric units and may or may not include other monomeric units.

"Coagulant" means a composition of matter having a higher charge density and lower molecular weight than a flocculant, which when added to a liquid containing finely divided suspended particles, destabilizes and aggregates the solids through the mechanism of ionic charge neutralization.

"DADMAC" means monomeric units of diallyldimethylammonium chloride, DADMAC can be present in a homopolymer or in a copolymer comprising other monomeric units.

"Flocculant" means a composition of matter having a low charge density and a high molecular weight (in excess of 1,000,000) which when added to a liquid containing finely divided suspended particles, destabilizes and aggregates the solids through the mechanism of interparticle bridging.

"Flocculating Agent" means a composition of matter which when added to a liquid destabilizes, and aggregates colloidal and finely divided suspended particles in the liquid, flocculants and coagulants can be flocculating agents.

"GCC" means ground calcium carbonate filler particles, which are manufactured by grinding naturally occurring calcium carbonate rock.

"GPAM" means glyoxalated polyacrylamide, which is a polymer made from polymerized acrylamide monomers (which may or may not be a copolymer comprising one or more other monomers as well) and in which acrylamide polymeric units have been reacted with glyoxal groups, representative examples of GPAM are described in US Published Patent Application 2009/0165978.

"Natural Gum" means a polysaccharide characterized as being originally of natural origin and which when placed in a solution imposes a large viscosity increase in said solution even when in a small concentration, natural gum includes a number of plant resins and includes but is not limited to seaweed polyelectrolytes such as agar, alginic acid, sodium alginate, carrageenan, botanical polyelectrolytes such as gum arabic from acacia tree sap, gum ghatti from anogeissus tree sap, gum tragacanth from astragalus shrub sap, karaya gum from anogeissus tree sap, gum tragacanth from astragalus shrub sap, kararya gum from sterculia tree sap, uncharged botanicals such as guar gum from guar beans, locust bean gum from carob tree seeds, beta-glucan from oat and barley bran, chicle gum from chicle trees, dammar gum from dipterocarpaceae tree sap, glucommannan from koniac plants, mastic gum from mastic trees, psyllium seed husks from plantago plants, spruce gum from spruce trees, tara gum from tara tree seeds, and bacterial fermentation products such as gellan gum and xantham gum, "natural gum" also includes natural gum derivatives.

"Natural Gum Derivative" means a natural gum polysaccharide which has undergone some measure of chemical substitution of one or more of the subgroups (e.g. carboxymethyl, hydroxypropyl) in one, some or all of the monomer units in the polysaccharide backbone, the substitute constituents typically comprise one or more of sulfate, carboxylic acid (found in carragenan, alginate, pectin), carboxylic ester, pyruvic acid (found in pectin, xanthan gum, zooglan, and methylan), carboxymethyl, hydroxypropyl, methyl, methylethyl, hydroxyethyl, hydroxyethylmethyl and the like.

"PCC" means precipitated calcium carbonate filler particles, which are synthetically produced.

"Polysaccharide" means a polymeric carbohydrate having a plurality of repeating units comprised of simple sugars, the C—O—C linkage formed between two such joined simple sugar units in a polysaccharide chain is called a glycosidic linkage, and continued condensation of monosaccharide units will result in polysaccharides, common polysaccharides are amylose and cellulose, both made up of glucose monomers, polysaccharides can have a straight chain or branched polymer backbone including one or more sugar monomers, common sugar monomers in polysaccharides include glucose, galactose, arabinose, mannose, fructose, rahmnose, and xylose.

"Preflocculation" means the modification of filler particles through treatment with coagulants and/or flocculants prior to their addition to the paper stock, in such an amount that actual flocculation does not occur, preflocculation is not conducted in the presence of the paper stock, typically after preflocculation, more of the same or a different kind of coagulant and/or flocculant is subsequently added to the preflocculated filler particles to initiate actual flocculation.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference, In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

In at least one embodiment of the invention is a method of making paper Which comprises filler. In at least one embodiment of the invention the method of papermaking comprises the steps of adding at least one natural gum to filler particles and/or to paper mat containing filler particles. In at least one embodiment also added to the filler particles and/or to paper mat is a wet web strength additive or drainage aid or wet strength aid to the paper mat. In at least one embodiment the wet web strength additive comprises GPAM.

The combination of a wet web strength additive with a natural gum results in a surprising synergy which increases the strength of the resulting paper by more than the sum of either of the two added alone. This inventive combination also solves some of the problems inherent in using wet web strength additives in papermaking as well as in using natural gums. It has been known for some time that adding wet web strength additives or drainage aid or wet strength aid to paper mat increases the wet web strength of the resulting paper or enhances drainage or improves machine speed and runnability or enhance sheet wet strength. Some examples of wet strength aids, wet web strength additives and drainage aids are described in U.S. Pat. Nos. 7,125,469, 7,615,135 and 7,641,776.

Unfortunately it is not practical to add large amounts of wet strength aids or wet web strength additives or drainage aids to compensate for the weakness due to large amounts of filler in paper mat. One reason is because those additives are expensive and using large amounts of additives would result in production costs that are commercially non-viable. In addition, adding too much additive negatively affects the process of papermaking and inhibits the operability of various forms of papermaking equipment. Furthermore cellulose fibers can only adsorb a limited amount of wet strength aid or wet web strength additive or drainage aid. This imposes a limit on how much additive can be used. One reason why this is so is because wet strength aid or wet web strength additive or drainage aid tend to neutralize the anionic fiber/filler charges and when these charges are neutralized further adsorption of those additives is inhibited.

Adding filler to the paper mat also reduces the effectiveness of the wet strength aid or wet web strength additive or drainage aid. Those additives have a tendency to coat the filler particles. The more filler particles present, the more additive coats the filler particles, and therefore there is less wet strength aid or wet web strength additive or drainage available to bind the cellulose fibers together. Because there is a maximum amount of wet strength aid or wet web strength additive or drainage that can be added, more filler has always meant less effective strength additive. This effect is more acute with PCC than GCC because PCC's higher surface area becomes more coated with the additives than GCC.

U.S. Pat. No. 5,458,679 describes treating filler particles with polysaccharides. However it fails to describe how using the polysaccharides to alter the viscosity of the filler particles would enhance the strength properties of the resulting paper. Details regarding the viscosity imparting effects of natural gums can be found in the scientific article: *Alternan and highly branched limit dextrans: Low-viscosity polysaccharides as potential new food ingredients*, by Gregory L. Cote et al., In: Spanier A. M. et al. (ed) Chemistry of Novel Foods, Carol Stream, Ill.: Allured Publishing Corp, pgs, 95-110 (1997) which discusses such natural gums as alternan and gum arabic (in particular FIGS. 2 and 3). In at least one embodiment the viscosity of the filler containing composition (which will later be added to paper mat) is increased by between 10-100% by the presence of natural gums with the filler particles.

In at least one embodiment of the invention at least some of the filler particles are pre-treated with a pre-treating composition comprising at least one natural gum to at least partially prevent the adherence of wet strength aid or wet web strength additive or drainage aid to the filler particles. The pre-treatment may involve entirely coating some or all of one or more filler particles with the natural gum. In the alternative, the pre-treatment contemplates applying the natural gum to only a portion of one or more of the filler particles, or completely coating some filler particles and applying the natural gum to only a portion of some other particles. The natural gum may be applied to the filler particles, before, after, or simultaneous to one or more steps of the other filler pre-treatment(s).

In at least one embodiment, in addition to contacting the filler particles with natural gums, the filler particles are also treated according at least one of the methods and compositions described in U.S. patent application Ser. No. 12/323,976 titled METHOD OF INCREASING FILLER CONTENT IN PAPERMAKING. In at least one embodiment, the treating composition of matter is any one of or combination of the compositions of matter described in U.S. Pat. No. 6,592,718. In particular, any of the AcAm/DADMAC copolymer compositions described in detail therein are suitable as the treating composition of matter. An example of an AcAm/DADMAC copolymer composition is product# Nalco-4690 from Nalco Company of Naperville, Ill. (hereinafter referred to as 4690).

The treating composition of matter can be a coagulant. The coagulants encompassed in this invention are well known and commercially available. They may be inorganic or organic. Representative inorganic coagulants include alum, sodium aluminate, polyaluminum chlorides or PACs (which are also known as aluminum chlorohydroxide, aluminum hydroxide chloride, and polyaluminum hydroxychloride), sulfated polyaluminum chlorides, polyaluminum silica sulfate, ferric sulfate, ferric chloride, and the like and blends thereof.

Some organic coagulants suitable as a treating composition of matter are formed by condensation polymerization. Examples of polymers of this type include epichlorohydrin-dimethylamine (EPI-DMA), and EPI-DMA ammonia crosslinked polymers.

Additional coagulants suitable as a treating composition of matter include polymers of ethylene dichloride and ammonia, or ethylene dichloride and dimethylamine, with or without the addition of ammonia, condensation polymers of multifunctional amines such as diethylenetriamine, tetraethylenepentamine, hexamethylenediamine and the like with ethylenedichloride and polymers made by condensation reactions such as melamine formaldehyde resins.

Additional coagulants suitable as a treating composition of matter include cationically charged vinyl addition polymers such as polymers, copolymers, and terpolymers of (meth) acrylamide, diallyl-N,N-disubstituted ammonium halide, dimethylaminoethyl methacrylate and its quaternary ammonium salts, dimethylaminoethyl acrylate and its quaternary ammonium salts, methacrylamidopropyltrimethylammonium chloride, diallylmethyl(beta-propionamido)ammonium chloride, (beta-methacryloyloxyethyl)trimethyl ammonium methylsulfate, quaternized polyvinyllactam, vinylamine, and acrylamide or methacrylamide that has been reacted to produce the Mannich or quaternary Mannich derivatives. Preferable quaternary ammonium salts may be produced using methyl chloride, dimethyl sulfate, or benzyl chloride. The terpolymers may include anionic monomers such as acrylic acid or 2-acrylamido 2-methylpropane sulfonic acid as long as the overall charge on the polymer is cationic. The molecular weights of these polymers, both vinyl addition and condensation, range from as low as several hundred to as high as several million. Preferably, the molecular weight range should be from about 20,000 to about 1,000,000. In at least one embodiment, the pre-treatment is preformed by a combination of one, some, or all of any of the compositions of matter described as suitable compositions of matter for pre-treating the filler particles.

While pre-treating filler particles is known in the art, prior art methods of pre-treating filler particles are not directed towards affecting the adhesion of the wet strength aid or wet web strength additive or drainage aid to the filler particles. In fact, many prior art pre-treatments increase the adhesion of the strength additive to the filler particles. For example, U.S. Pat. No. 7,211,608 describes a method of pre-treating filler particles with hydrophobic polymers. This pre-treatment however does nothing to the adhesion between the strength additive and the filler particles and merely repels water to counterbalance an excess of water absorbed by the strength additive. In contrast, the invention decreases the interactions between the wet strength aid or wet web strength additive or drainage aid and the filler particles and results in an unexpectedly huge increase in paper strength, sheet dewatering and machine runability.

In at least one embodiment, in addition to contacting the filler particles with natural gums, the filler particles are also preflocculated according at least one of the utilizing the methods and compositions described in U.S. Pat. No. 8,172,983. In at least one embodiment the method of preparing a stable dispersion of flocculated filler particles having a specific particle size distribution for use in papermaking processes comprises the steps of a) providing an aqueous dispersion of filler particles; b) adding at least one natural gum to the dispersion, c) adding a first flocculating agent to the dispersion in an amount sufficient to mix uniformly in the dispersion without causing significant flocculation of the filler particles; d) adding a second flocculating agent to the dispersion in an amount sufficient to initiate flocculation of the filler particles in the presence of the first flocculating agent; and e) optionally shearing the flocculated dispersion to provide a dispersion of filler flocs having the desired particle size.

At least some of the fillers encompassed by this invention are well known and commercially available. They include any inorganic or organic particle or pigment used to increase the opacity or brightness, reduce the porosity, or reduce the cost of the paper or paperboard sheet. The most common fillers are calcium carbonate and clay. However, talc, titanium dioxide, alumina trihydrate, barium sulfate, and magnesium hydroxide are also suitable fillers. Calcium carbonate includes ground calcium carbonate (GCC) in a dry or dispersed slurry form, chalk, precipitated calcium carbonate (PCC) of any morphology, and precipitated calcium carbonate in a dispersed slurry form. The dispersed slurry forms of GCC or PCC are typically produced using polyacrylic acid polymer dispersants or sodium polyphosphate dispersants. Each of these dispersants imparts a significant anionic charge to the calcium carbonate particles. Kaolin clay slurries also are dispersed using polyacrylic acid polymers or sodium polyphosphate.

In at least one embodiment, the wet strength aids, wet web strength additives, dry strength additives or drainage aids encompassed by the invention include any one of the compositions of matter described in U.S. Pat. No. 4,605,702 and US Patent Application 2005/0161181 A1 and in particular the various glyoxylated Acrylamide/DADMAC copolymer compositions described therein. An example of a glyoxylated Acrylamide/DADMAC copolymer composition is product# Nalco 63700 (made by Nalco Company, Naperville, Ill.). Another example of is amine-containing polymers including allylamine/acrylamide copolymers and polyvinylamines; one more example is Polyamide-Polyamine-Epichlorohydrin (PAE)

In at least one embodiment, the fillers used are PCC, GCC, and/or kaolin clay. In at least one embodiment, the fillers used are PCC, GCC, and/or kaolin clay with polyacrylic acid polymer dispersants or their blends. The ratio of wet strength additive or wet web strength aid or drainage additive relative to solid paper mat can be 3 kg of additive per ton of paper mat.

In at least one embodiment the method of making paper products from pulp comprises the steps of forming an aqueous cellulosic papermaking furnish, adding an aqueous dispersion of filler slurry combined with the addition of natural gums and wet web strength agent, wet strength agent dry strength agent or draining aids to the furnish, draining the furnish to form a sheet and drying the sheet. The steps of forming the papermaking furnish, draining and drying may be carried out in any conventional manner generally known to those skilled in the art.

In at least one embodiment the method of making paper products from pulp comprises the steps of forming an aqueous cellulosic papermaking furnish, pretreating the filler slurry according at least one of the methods and compositions described in U.S. patent application Ser. No. 12/323,976, or preflocculated according at least one of the methods and compositions described in U.S. Pat. No. 8,172,983, combined with the addition of natural gums and wet web strength agent, wet strength agent, dry strength agent or draining aids to the furnish, draining the furnish to form a sheet and drying the sheet. The steps of forming the papermaking furnish, draining and drying may be carried out in any conventional manner generally known to those skilled in the art.

EXAMPLES

The foregoing may be better understood by reference to the following examples, which are presented for purposes of illustration and are not intended to limit the scope of the invention.

Unless otherwise stated, the following is the general procedure used for all handsheet studies. A filler stock was prepared using Albacar HO PCC as filler. The fiber stock was a 75/25 HWK/SWK blend. Sheet basis weight was maintained at around 80 g/m$^2$. Six replicate handsheets were produced for each experimental condition. The thin stock for each bulk handsheet was mixed in a dynamic drainage jar at 800 rpm. For the basesheets, the desired amount of PCC, natural gum/GPAM, cationic starch, alkenyl succinic anhydride, and a cationic flocculant were added in 15-second intervals. After mixing, the basesheet was formed in a handsheet mold using an 80-mesh screen. Once formed the sheets were pressed in a static press at 0.565 MPa for 5 minutes and then dried in a drum drier at 210° F. for one minute. Sheet strength measurements were conducted at 50% relative humidity at 23° C.

TSI means tensile strength index measured in N·m/g. ABL, is the measurement of abrasion loss, which was measured according to TAPPI test method. T476 which is a measure of surface strength. ABL is measured in units of mg/1000 revs. The lower the abrasion loss, the stronger the surface is.

Example 1

This study was designed to show the strength performance of the natural gum when it is used to treat the filler before addition to the fiber slurry and a strength aid is added to the wet end. Table 1 summarizes the experimental design and measured results.

TABLE 1

Experimental Design and Results

| Experimental Design | | | | Measured Results | | | | | |
|---|---|---|---|---|---|---|---|---|---|
| # | Filler treatment | Target ash (%) | GPAM (lb/ton) | True ash (%) | Predicted opacity | Brightness | TSI | ZDT (kPa) | ABL |
| 1 | Untreated | 20 | 0 | 16.4 | 93.99 | 89.68 | 34.1 | 512 | 623 |
| 2 | Untreated | 30 | 0 | 25.4 | 95.41 | 90.25 | 24.3 | 427 | 1363 |
| 3 | Xanthan gum | 20 | 1 | 17.1 | 94.04 | 89.16 | 35.6 | 506 | 498 |
| 4 | Xanthan gum | 30 | 0 | 24.6 | 95.06 | 90.32 | 27.7 | 444 | 983 |
| 5 | Untreated | 20 | 6 | 18.1 | 94.46 | 88.99 | 32.7 | 511 | 471 |

TABLE 1-continued

| Experimental Design and Results | | | | | | | | | |
|---|---|---|---|---|---|---|---|---|---|
| | Experimental Design | | | Measured Results | | | | | |
| # | Filler treatment | Target ash (%) | GPAM (lb/ton) | True ash (%) | Predicted opacity | Brightness | TSI | ZDT (kPa) | ABL |
| 6 | Untreated | 30 | 6 | 28.4 | 95.25 | 90.97 | 22.7 | 412 | 1346 |
| 7 | Xanthan gum | 20 | 6 | 18.5 | 93.66 | 89.41 | 37.0 | 541 | 296 |
| 8 | Xanthan gum | 30 | 6 | 27.5 | 94.94 | 90.48 | 28.3 | 457 | 784 |

The results of this example demonstrate that the combination of a natural gum (whose representative example is xanthan but is assumed to apply to many or all natural gums) with a strength additive (whose representative example is GPAM but is assumed to apply to many or all natural gums) results in an unexpected synergistic effect. When both are applied to the furnish the effect was better than if either were added alone. Adding GPAM alone in the wet end produced almost no beneficial effect. Adding xanthan alone in the wet end produced a small benefit. The combination of GPAM with xantham however produced a large effect far out of proportion to the individual contributions of either. This large effect demonstrates a novel unexpected synergy results from their combination.

Example 2

This study was designed to show the performance of the natural gum and the strength aid independently of the feed point of the natural gum. Table 2 summarizes the conditions and results. TSI means tensile strength index measured in N·m/g. ABL in in the final column is the measurement of abrasion loss. ABL was measured according to LEON test method T476 which is a measure of surface strength. TSI is measured in terms of mg/1000 revs. The lower the abrasions loss, the stronger the surface is. True ash is a measure of how much of the added filler actually end up in the resulting paper sheet.

TABLE 2

| Experimental Design and Results | | | | | | | | | | |
|---|---|---|---|---|---|---|---|---|---|---|
| | Experimental Design | | | | Measured Results | | | | | |
| # | Target Ash % | Filler treatment xanthan gum (lb/ton) | Wet end xanthan gum (lb/ton) | GPAM (lb/ton) | True Ash (%) | Opacity at 80 gsm | Brightness | TSI | ZDT (kPa) | ABL |
| 1 | 20 | 0 | 0 | 0 | 18.7 | 93.98 | 90.15 | 30.8 | 473 | 764 |
| 2 | 30 | 0 | 0 | 0 | 28.2 | 95.10 | 90.97 | 22.0 | 365 | 1664 |
| 3 | 20 | 0 | 1 | 6 | 19.6 | 93.49 | 89.85 | 35.0 | 510 | 395 |
| 4 | 30 | 0 | 1 | 6 | 28.3 | 94.77 | 90.96 | 25.2 | 434 | 935 |
| 5 | 20 | 0.6 | 0 | 6 | 18.8 | 93.23 | 89.75 | 35.9 | 520 | 362 |
| 6 | 30 | 0.9 | 0 | 6 | 29.0 | 94.63 | 90.75 | 26.9 | 445 | 846 |

This example demonstrates that for paper sheets having similar True Ash levels, the natural gum-strength additive synergy manifests if the natural gum is added in either to the filler before it contacts the paper material or within the wet end of the papermaking process.

Example 3

The following study was designed to compare the performance of two distinct natural gums, namely, xanthan gum and guar gum. A strength aid is immediately added in each case when a natural gum is added in the wet end. Table 3 summarizes the experimental design and results.

TABLE 3

| Experimental Design and Results | | | | | | | | |
|---|---|---|---|---|---|---|---|---|
| | Experimental Design | | | | Measured Results | | | |
| # | Target Ash (%) | Xanthan gum (lb/t) | Guar gum (lb/t) | GPAM (lb/t) | True ash (%) | TSI | ZDT (kPa) | ABL |
| 1 | 20 | 0 | 0 | 0 | 18.9 | 31.7 | 497 | 1792 |
| 2 | 30 | 0 | 0 | 0 | 27.7 | 23.8 | 410 | 2917 |
| 3 | 20 | 1 | 0 | 6 | 19.4 | 36.2 | 551 | 1372 |
| 4 | 30 | 1 | 0 | 6 | 28.1 | 26.0 | 473 | 2272 |
| 5 | 20 | 0 | 1 | 6 | 18.7 | 35.6 | 547 | 1435 |
| 6 | 30 | 0 | 1 | 6 | 27.7 | 25.6 | 455 | 2423 |

The results of this example show that the synergy displayed by xanthan is representative of a property that is shared by many or all natural gums.

Example 4

This study was designed to map the performance of the natural gum-strength aid as a function of both chemistries. Table 4 summarizes the experimental design and results.

TABLE 4

Experimental Design and Results.

| # | Filler Treatment | Target Ash (%) | Xanthan gum (lb/t) | GPAM (lb/t) | True Ash (%) | TSI | ZDT (kPa) | ABL |
|---|---|---|---|---|---|---|---|---|
| | Experimental Design | | | | Measured Results | | | |
| 1 | Untreated | 20 | 0.00 | 0 | 16.5 | 33.6 | 503 | 966 |
| 3 | Untreated | 25 | 0.00 | 0 | 20.5 | 29.5 | 481 | 1288 |
| 2 | Untreated | 30 | 0.00 | 0 | 24.2 | 25.7 | 442 | 1601 |
| 3 | Untreated | 25 | 0.00 | 0 | 20.5 | 29.5 | 481 | 1288 |
| 4 | Untreated | 25 | 0.00 | 2 | 21.6 | 29.8 | 484 | 1211 |
| 5 | Untreated | 25 | 0.00 | 4 | 22.0 | 27.8 | 470 | 1243 |
| 6 | Untreated | 25 | 0.91 | 0 | 20.4 | 30.7 | 494 | 1111 |
| 7 | Untreated | 25 | 0.91 | 2 | 21.9 | 31.0 | 514 | 1000 |
| 8 | Untreated | 25 | 0.91 | 4 | 22.0 | 31.1 | 521 | 980 |
| 9 | Xanthan gum | 25 | 0.00 | 0 | 21.5 | 30.3 | 493 | 1192 |
| 10 | Xanthan gum | 25 | 0.00 | 12 | 22.5 | 31.5 | 498 | 1101 |
| 11 | Xanthan gum | 25 | 0.00 | 4 | 22.8 | 32.3 | 506 | 986 |

Example 5

This study was designed to show the performance of guar gum addition to the stock followed by a strength aid. Table 5 summarizes the experimental design and results.

TABLE 5

Experimental Design and Results.

| # | Guar gum (lb/t) | GPAM (lb/t) | Ash (%) | TSI | ZDT (kPa) | ABL |
|---|---|---|---|---|---|---|
| | Experimental Design | | Measured Results | | | |
| 1 | 0 | 0 | 16.5 | 34.6 | 513 | 1006 |
| 2 | 0 | 0 | 25.5 | 26.4 | 420 | 1675 |
| 3 | 0 | 0 | 21.2 | 29.8 | 469 | 1298 |
| 4 | 1 | 0 | 20.9 | 31.2 | 471 | 1281 |
| 5 | 0 | 4 | 22.7 | 30.1 | 485 | 1252 |
| 6 | 1 | 4 | 22.9 | 31.9 | 497 | 1107 |

A person of ordinary skill in the art will recognize that all of the previously described methods are also applicable to paper mat comprising other non-cellulose based fibrous materials, paper mats comprising a mixture of cellulose based and non-cellulose based fibrous materials, and/or synthetic fibrous based materials.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or more of the various embodiments described herein and/or incorporated herein.

The above disclosure is intended to be illustrative and not exhaustive. This description will suggest many variations and alternatives to one of ordinary skill in this art. The compositions and methods disclosed herein may comprise, consist of or consist essentially of the listed components, or steps. As used herein the term "comprising" means "including, but not limited to". As used herein the term "consisting essentially of" refers to a composition or method that includes the disclosed components or steps, and any other components or steps that do not materially affect the novel and basic characteristics of the compositions or methods. For example, compositions that consist essentially of listed ingredients do not contain additional ingredients that would affect the properties of those compositions. Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

All numeric values are herein assumed to be modified by the term "about," whether or not explicitly indicated. The term "about" generally refers to a range of numbers that one of skill in the art would consider equivalent to the recited value having the same function or result). In many instances, the term "about" may include numbers that are rounded to the nearest significant figure. Weight percent, percent by weight, % by weight, wt %, and the like are synonyms that refer to the concentration of a substance as the weight of that substance divided by the weight of the composition and multiplied by 100.

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of papermaking comprising:

combining a filler containing composition, glyoxylated acrylamide/DADMAC copolymer, and cellulose fiber stock comprising a plurality of cellulose fibers and water, thereby forming a combination; and forming a paper mat from the combination;

wherein the filler containing composition comprises mineral particles and a natural gum coating at least a portion of the mineral particles, the natural gum selected from the group consisting of: xanthan gum, guar gum, derivatives thereof, and combinations thereof, wherein the filler containing composition has a viscosity of from 10% to 100% greater than a filler containing composition absent the natural gum.

2. The method of claim 1, wherein the combination further comprises a drainage aid.

3. The method of claim 1, wherein the mineral particles comprise calcium carbonate.

4. The method of claim 3, wherein the calcium carbonate is selected from the group consisting of: undispersed calcium carbonate, dispersed slurry calcium carbonate, chalk, PCC, GCC, and combinations thereof.

5. The method of claim 3, wherein at least a portion of the calcium carbonate is dispersed slurry calcium carbonate.

6. The method of claim 5, wherein the calcium carbonate dispersed slurry further comprises at least one item selected from the group consisting of: a polyacrylic acid polymer dispersant, a sodium polyphosphate dispersant, Kaolin clay, and combinations thereof.

7. The method of claim 1, wherein the combination further comprises a coagulant.

8. The method of claim 7, wherein the coagulant is selected from the group consisting of: an inorganic coagulant, an organic coagulant, a condensation polymerization coagulant, and combinations thereof.

9. The method of claim 7, wherein the coagulant is selected from the group consisting of: alum, sodium aluminate, a polyaluminum chloride, aluminum chlorohydroxide, aluminum hydroxide chloride, polyaluminum hydroxychloride, a sulfated polyaluminum chloride, polyaluminum silica sulfate, ferric sulfate, ferric chloride, epichlorohydrin-dimethylamine ("EPI-DMA"), an EPI-DMA ammonia crosslinked polymer, a polymer of ethylene dichloride and ammonia, a polymer of ethylene dichloride, a polymer of dimethylamine, a condensation polymer of multifunctional diethylenetriamine, a condensation polymer of multifunctional tetraethylenepentamine, a condensation polymer of multifunctional hexamethylenediamine, a condensation polymer of multifunctional ethylenedichloride, a melamine polymer, a formaldehyde resin polymer, a cationically charged vinyl addition polymer, and combinations thereof.

10. The method of claim 7, wherein the coagulant is an AcAm/DADMAC copolymer.

11. The method of claim 1, wherein the glyoxylated acrylamide/DADMAC copolymer is present in the paper mat at a ratio of 0.3 to 5 kg of strength additive per ton of the solid portion of the paper mat.

12. The method of claim 1, wherein the paper mat has a solid portion, and the filler in the paper mat comprises up to 50% by mass of the solid portion of the paper mat.

* * * * *